US007856794B2

(12) United States Patent
Zieher

(10) Patent No.: US 7,856,794 B2
(45) Date of Patent: Dec. 28, 2010

(54) DEVICE FOR INDIVIDUAL PACKING OF TABLETS ACCORDING TO A MULTI-DOSE SYSTEM

(76) Inventor: Wolfgang Zieher, Parkhofstrasse 26, D-41836 Hückelhoven (DE)

( * ) Notice: Subject to any disclaimer, the term of this patent is extended or adjusted under 35 U.S.C. 154(b) by 22 days.

(21) Appl. No.: 11/921,490

(22) PCT Filed: Jun. 6, 2006

(86) PCT No.: PCT/DE2006/000947

§ 371 (c)(1),
(2), (4) Date: Dec. 3, 2007

(87) PCT Pub. No.: WO2006/128443

PCT Pub. Date: Dec. 7, 2006

(65) Prior Publication Data

US 2009/0120042 A1 May 14, 2009

(30) Foreign Application Priority Data

Jun. 3, 2005 (DE) ..... 20 2005 008 656 U
Feb. 16, 2006 (DE) ..... 10 2006 007 136

(51) Int. Cl.
*B65B 5/04* (2006.01)
*B65B 3/28* (2006.01)

(52) U.S. Cl. ..... 53/246; 53/249; 53/502

(58) Field of Classification Search ..... 53/244, 53/245, 246, 248, 249, 131.2, 51, 499, 500, 53/502

See application file for complete search history.

(56) References Cited

U.S. PATENT DOCUMENTS 3,392,506 A 7/1968 Haines
3,754,374 A 8/1973 Haines
3,775,941 A * 12/1973 Bross ..... 53/246
4,233,799 A * 11/1980 Caille ..... 53/246
4,453,575 A * 6/1984 Del Rosso ..... 141/83
4,627,225 A * 12/1986 Faller et al. ..... 53/244
4,640,376 A * 2/1987 Hinzpeter ..... 177/50
4,655,026 A * 4/1987 Wigoda ..... 53/246
4,693,057 A 9/1987 Rittinger et al.
5,329,749 A * 7/1994 Yamamoto et al. ..... 53/246
5,365,717 A * 11/1994 McKinlay ..... 53/246
5,439,036 A * 8/1995 Kramer ..... 141/83

(Continued)

FOREIGN PATENT DOCUMENTS

CH 662 993 11/1987

(Continued)

OTHER PUBLICATIONS

International Search Report.

*Primary Examiner*—Louis K Huynh
(74) *Attorney, Agent, or Firm*—Collard & Roe, P.C.

(57) ABSTRACT

A device for the individual packaging of pharmaceutical tablets comprising a charging template (1) with recesses (5) for receiving tablets (11) of dosage at given times, the recesses (5) have recess bases (6) for openable by a displaceable arranged control template (2) to pass on the tablet (11), a tablet container (3), physically arranged below the charging template (1) such as to be displaced relative to the charging template (1) and having compartments for transfer of the tablets (11), and a weighing scale positioned beneath the charging template (1) and above the tablet container (3) for checking the weight of the tablets (11) assigned to the charging template (1).

25 Claims, 5 Drawing Sheets

U.S. PATENT DOCUMENTS

| | | | | |
|---|---|---|---|---|
| 5,737,902 | A * | 4/1998 | Aylward | 53/246 |
| 5,752,366 | A * | 5/1998 | Wilfong et al. | 53/246 |
| 5,806,287 | A * | 9/1998 | Trechsel | 53/502 |
| 6,318,051 | B1 | 11/2001 | Preiss | |
| 6,497,083 | B1 * | 12/2002 | Garwood et al. | 53/246 |
| 6,761,010 | B1 * | 7/2004 | Gibson | 53/246 |
| 7,069,964 | B1 * | 7/2006 | Kakuda | 141/83 |
| 2005/0060962 | A1 * | 3/2005 | Rothbauer et al. | 53/502 |

FOREIGN PATENT DOCUMENTS

| | | |
|---|---|---|
| DE | 22 62 951 | 6/1974 |
| FR | 2 786 158 | 5/2000 |
| GB | 2 177 074 | 1/1987 |

* cited by examiner 1
2
3
4
4a
5
6
7
8
9
10
11
12
13
14
15
20
21
22
23
24
25
26
27
28
29
30

DEVICE FOR INDIVIDUAL PACKING OF TABLETS ACCORDING TO A MULTI-DOSE SYSTEM

CROSS REFERENCE TO RELATED APPLICATIONS

Applicant claims priority under 35 U.S.C. §119 of German Application No. 20 2005 008 656.8 filed Jun. 3, 2005 and German Application No. 10 2006 007 136.0 filed Feb. 16, 2006. Applicant also claims priority under 35 U.S.C. §365 of PCT/DE2006/000947 filed Jun. 6, 2006. The international application under PCT article 21(2) was not published in English.

BACKGROUND OF THE INVENTION

1. Field of the Invention

The invention relates to a device for individual packaging of medication tablets according to a multi-dose system. In the following connection, the term "medication tablets" comprises solid, oral forms of medication, in other words whole or parts of tablets, coated tablets, film tablets, capsules, etc. In the following, these are always (also) meant when the term "tablets" is used.

2. The Prior Art

In supplying medications to nursing home residents and also other aged or chronically ill citizens, the problem occurs that several medications frequently have to be taken at different times of day. In the case of nursing home residents, the medications are made available by the care personnel. This work is generally not very much appreciated by the care personnel, because the activity is time-consuming and prone to error. Therefore, individual packaging is already available in pharmacies, where individual packs, tailored to the specific persons, generally for a week at a time, so-called weekly packs, are produced. However, placing the individual tablets into the packs by hand is not only time-consuming, and the corresponding costs are not covered by the profit margin of the medications, but also, this process is prone to error.

One speaks of a multi-dose system if different tablets are prepared in individual compartments of a tablet container, individually, for a specific person, for an extended period of administration, for example a week. The contrast to this is a unit-dose system, having only a single type of tablet in a tablet pack. The term "tablet compartment" is to be understood generally in the present connection; for example, it also comprises small tablet bags.

Within the scope of the invention, medication cassettes, preferably having a flip-open or push-open lid (lower lid) or tablet blister packs (also with a plurality of tablet compartments) are possible tablet containers. In the case of blister packs, the compartments of which are generally sealed with a removable sealing film/foil, these are usually disposable packaging.

SUMMARY OF THE INVENTION

The invention is based on the task of creating a device that makes it possible to improve the efficiency of the production of individual packagings tailored to a specific person, in each instance, and, in particular, to preclude incorrect charging, using an EDP control.

For the device for individual packaging of tablets, as stated initially, the invention is described as follows. The solution is particularly characterized by a charging template having at least one nest for defined insertion of tablets to be taken on pre-determined days, e.g. weekdays, and/or times of day, e.g. in the morning (once or twice), at noon, in the evening, at night, whereby the nest(s) possess nest bottoms for passing the inserted tablets on, which bottoms are to be opened, preferably vertically towards the bottom (allowing the tablet to fall through), and by a tablet container disposed spatially underneath the charging template, to be displaceable relative to the latter, which container possesses compartments assigned to specific days and/or times of day, to be brought into coverage with the nest bottoms, for take-over of the tablets present in the nest(s). Some improvements and further embodiments of the invention are indicated as follows.

The region of the device according to the invention in which tablets are laid into the nests and then transferred from the charging template into a tablet container is also referred to as the charging region (or tablet feed station). Preferably, the charging region should already comprise all the means for preventing incorrect charging. If several and/or different tablets are to be laid into a nest, correspondingly many charging passes should follow one another in the charging region. After correct and complete charging of a tablet container has been determined, the container should be passed to a packaging station and sealed. If the container is a tablet blister pack, it can be brought into a sealing station, particularly a heat-sealing station.

The charging template according to the invention generally possesses seven nest columns for the insertion of tablets for the seven days of the week, and four or five nest rows that correspond to the times of day. Preferably, only one row of nests is supplied only with the same tablets, in other words only with one and the same type of tablet, and only for one time of day (in the morning on an empty stomach and/or after breakfast, at noon, in the evening, or at night), at every pass, i.e. work cycle. Zero or one tablet (one piece) should get into each nest per pass.

In order to avoid incorrect charging, it can additionally be advantageous to indicate, on the one hand, what nest is to be charged—because it can happen that a medication does not have to be taken every day—and, on the other hand, to check whether the individual tablet has gotten into the right nest. In order to prevent a tablet from being placed where no administration is to take place, each nest can be structured so that it can be closed off individually, so that insertion of a tablet is only possible on those days on which the medication is to be administered at the time of day of administration that is currently being worked on.

A photoeye can be used to detect whether a tablet has gotten into a nest in which it does not belong. Then, an alarm can be triggered by way of EDP, and the further process of charging can be stopped until this tablet has been removed again. An LED lamp or the like on every nest is possible for the display; photoeyes, preferably on or in every nest, and/or a scale are possible for checking whether or not a tablet was inserted. The photoeye, in each instance, should preferably be switched in such a manner that the LED goes out when a tablet gets into a nest. If a tablet too many falls into a nest, this becomes evident by means of activating the scale. In this way, it is assured that precisely zero or one single tablet gets into each nest of a row of nests, i.e. every compartment of a row of blister pack compartments, in accordance with the doctor's orders. Accordingly, two or more passes are required per row of nests or compartments, if two or more tablets are to be placed into at least one compartment. Of course, a new pass is also required for a new type of tablet.

The nests of the charging template according to the invention possess bottoms that can be opened in order to empty the nests into the compartments of a tablet container placed underneath. The tablet container, in each instance, and the charging template are positioned relative to one another in such a manner that the tablets placed into the nests, in each instance, drop precisely into the tablet compartments of the container that correspond to the time of administration that was pre-determined initially. Small electric motors are suitable for setting the relative movement, in each instance. Fundamentally, it lies within the scope of the invention to supply the nests, and thereby the tablet compartments, by time of day or by day, in each instance (in other words by rows, or by columns, or also individually).

For opening and closing the nest bottoms, a control template is preferred, within the scope of the invention, which closes the nest bottoms in one position and possesses openings that are to be brought into coverage with the nests in another position, so that the passage from the nest into the tablet compartment positioned underneath it, if applicable, is released.

In order to check whether the nests of a row (or column), i.e. the corresponding tablet compartments are charged with the correct number of tablets, after the tablets have been inserted, a (precision) scale is assigned to the charging template or the tablet container. The scale can be used to check whether precisely the correct number of tablets was inserted during the pass, in each instance.

In order to avoid incorrect charging, it can be advantageous, according to a further invention, to configure the tablet container in such a manner that it can only be introduced into the process in a single, defined position. This configuration can preferably be implemented by means of different dimensions of the tablet compartments (cavities) for individual times of administration, or other geometrical characteristics of the container.

It can be advantageous, within the scope of the invention, to configure the nest bottom, in each instance, as a scale pan. Since the scale that is used must be extraordinarily sensitive, a delay can occur during the weight determination if the nest and/or the inserted tablet is/are exposed to an air draft. Possibly, the weight value that is determined can be falsified as a result. According to a further invention, this problem is solved in that a cover, for example of glass, is moved over the nests before the weighing process, in each instance, is triggered. Then, an air draft can no longer influence the weight measurement.

If applicable, the weighing process is triggered after the nests are covered. If the weight is correct, the charging template, together with the cover, is displaced relative to the control template, in the tablet container, in order to transfer the tablets. This has the additional advantage that it is not possible to throw in any objects that do not belong in the container, during the transfer process; in other words, the aforementioned nest cover also represents security against sabotage and security against incorrect charging.—If it turns out, during the weighing process, that the prescribed weight is not present, an alarm is triggered and the cover is moved back again, to correct the content of the nests.

By means of the invention, a device for individual packaging of tablets is created, which is designed in such a manner that it is accessible to EDP control. For this purpose, a computer can be supplied with the relevant data (e.g. name and medication) of every individual patient. Furthermore, each individual preparation (each type of tablet) can be detected by the computer as it is delivered, for example by means of scanning. The computer can then control, i.e. regulate the entire system, for example the lamps and photoeyes on the aforementioned nests, the scale, in each instance, and the drives for relative movements of the various components of the device according to the invention, as well as the mechanical feed and removal of the tablets to be distributed, if applicable.

Once precisely all of the (possibly various) tablets that the patient, in each instance, is supposed to take during the week (or during any other time period that is being prepared), have been filled into the tablet container, the latter is closed. If the container is a blister pack, it is brought from the charging station to a packaging station, preferably configured with a heat-sealing station. A labeling, preferably individually on each tablet compartment, can be applied to the tablet container, for example, on a sealing film/foil; it should contain the name of the patient, the administration date and/or the administration time for every administration occasion. Preferably, medication documentation is additionally attached to the finished tablet container, so that it can be removed, e.g. with perforation.

In order to guarantee a prescribed position of the sealing film/foil on the blister pack, if applicable, it can be advantageous, according to a further invention, to provide the sealing film/foil with positioning aids. Preferably, fitting pins can be used for this purpose, which are situated in the blister accommodation for the sealing process. If applicable, punched holes should be situated in the (removable) sides of the sealing film/foil, which correspond with the fitting pins. When the film/foil is laid down, the punched holes are placed onto the fitting pins, so that all the films/foils are to be positioned in precisely the same way. After the sealing process, the positioning aids can be removed.

The aforementioned documentation can disclose the patient's address and the complete administration plan, including possible preparations that are not packaged (injection solutions, syrups, drops, ointments, suppositories, etc.), for example on its page 1. The medications to be administered separately can be emphasized, for example with colors. Furthermore, images of all of the tablets contained in the container, with their dimensions and weights, can be contained in the documentation, for example on page 2. If applicable, individual tablets can then be removed, in targeted manner, if the physician has changed the long-term medication.

Furthermore, free space can be left in the documentation (for example on page 3), for entering measurement values of the patient (e.g. blood pressure, blood sugar, etc.). Finally, all of the known adverse medication effects from all of the patient's medications can be listed in a short form (for example on page 4). After the documentation is removed from the tablet container, it should preferably be filed in the patient's record, or fixed in place on the patient's bed or in the patient's room.

According to a further invention, the transport of the tablets to/from the charging region of the charging template can take place mechanically, for example under EDP control—possibly by means of a warehouse robot or automatic commissioning device. In this operation, the tablets of a preparation can be situated—even loosely—in a special (preferably airtight) storage container, which is opened by machine when it is introduced into the charging region, after it has reached its pre-determined position, and is supposed to be sealed in airtight manner again, after completion of the individual metering pass, in each instance, by machine, and automatically transported away.

The individual parts of the device according to the invention, with charging template and, if applicable, control template, with the displacement drives, positioning device of the tablet container, and scale, in each instance, possess the indicated, specific spatial assignment with regard to one another, and can be built into a table, in such a manner that an ergonomically high-quality workstation is obtained. An EDP system for control, a printer for imprinting the labeling, particularly blister pack films/foils, and for the production of the aforementioned documentation, as well as one or more scanners for recognizing the delivery and removal of the medications, can be assigned to the device.

According to a further invention, that part of the packaging work which can also be performed manually, within the scope of the task stated initially, of precluding incorrect charging, is preferably carried out by hand, at least in a smaller operation, such as a pharmacy. If applicable, the tablet container is manually inserted into the device according to the invention, the charged tablet container is closed manually, and, if applicable, also provided with the relevant labeling, by hand, for example by gluing it on. If the tablet container is a blister pack, it can be set into the sealing die by hand, and the imprinted sealing film/foil can be laid on manually. At the conclusion, the documentation can be glued on manually. The capacity of such a partially manual workstation is approximately 1,000 tablet containers per week. This is sufficient even in the case of large pharmacies that have to supply many nursing homes.

BRIEF DESCRIPTION OF THE DRAWINGS

Details of the invention will be explained for the case of a blister pack as the tablet container, using the schematic representation of an exemplary embodiment. The figures show.

DETAILED DESCRIPTION OF PREFERRED EMBODIMENTS

Figure 1:
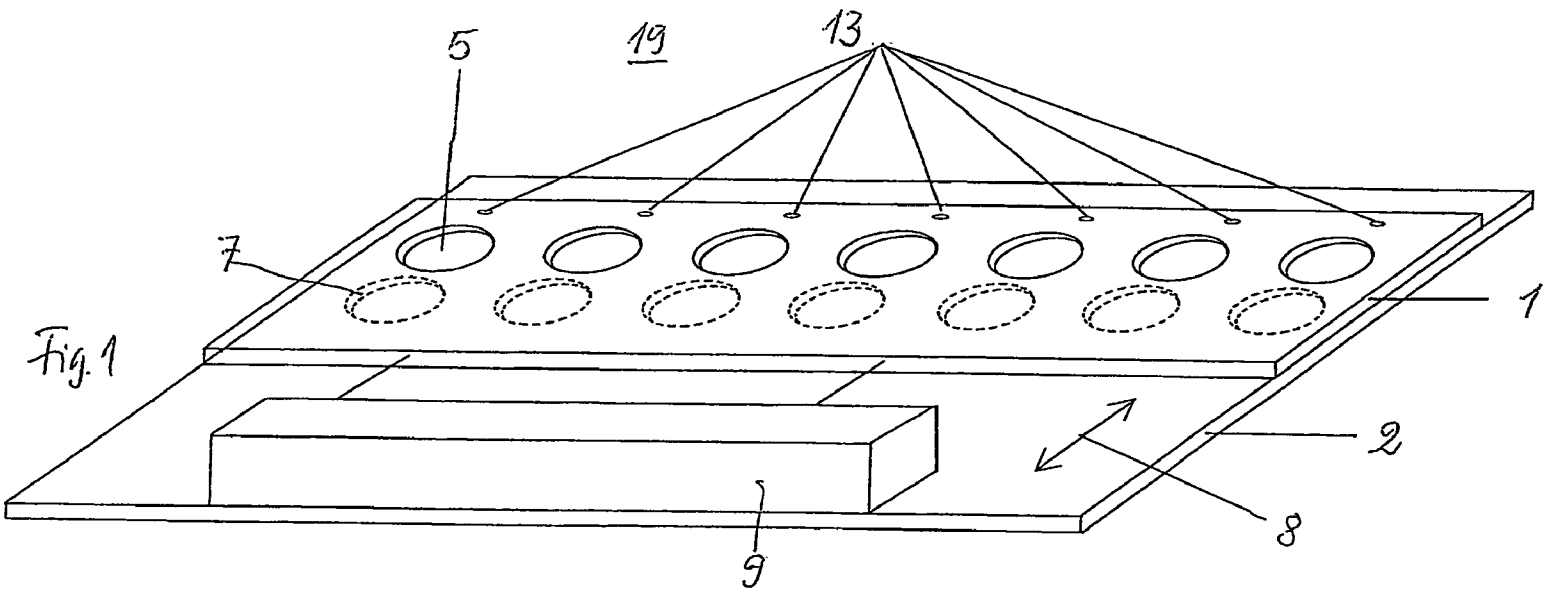
FIG. 1 a charging device shown in perspective, with closed nest bottoms, without a tablet container as yet.
Figure 2:
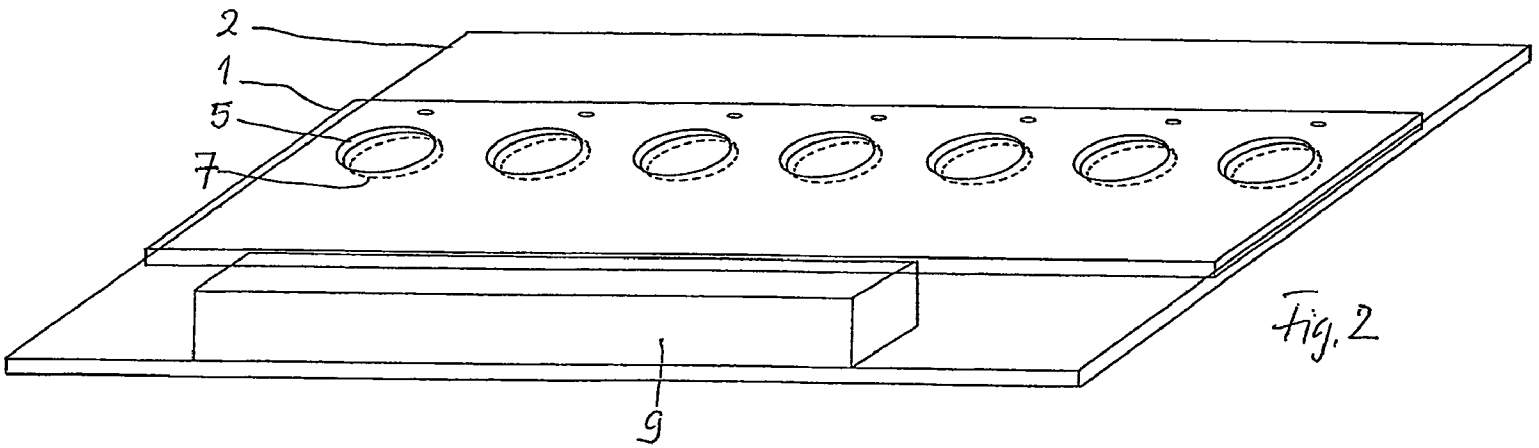
FIG. 2 a charging device according to FIG. 1, with opened nest bottoms.
Figures 3, 4, 6:
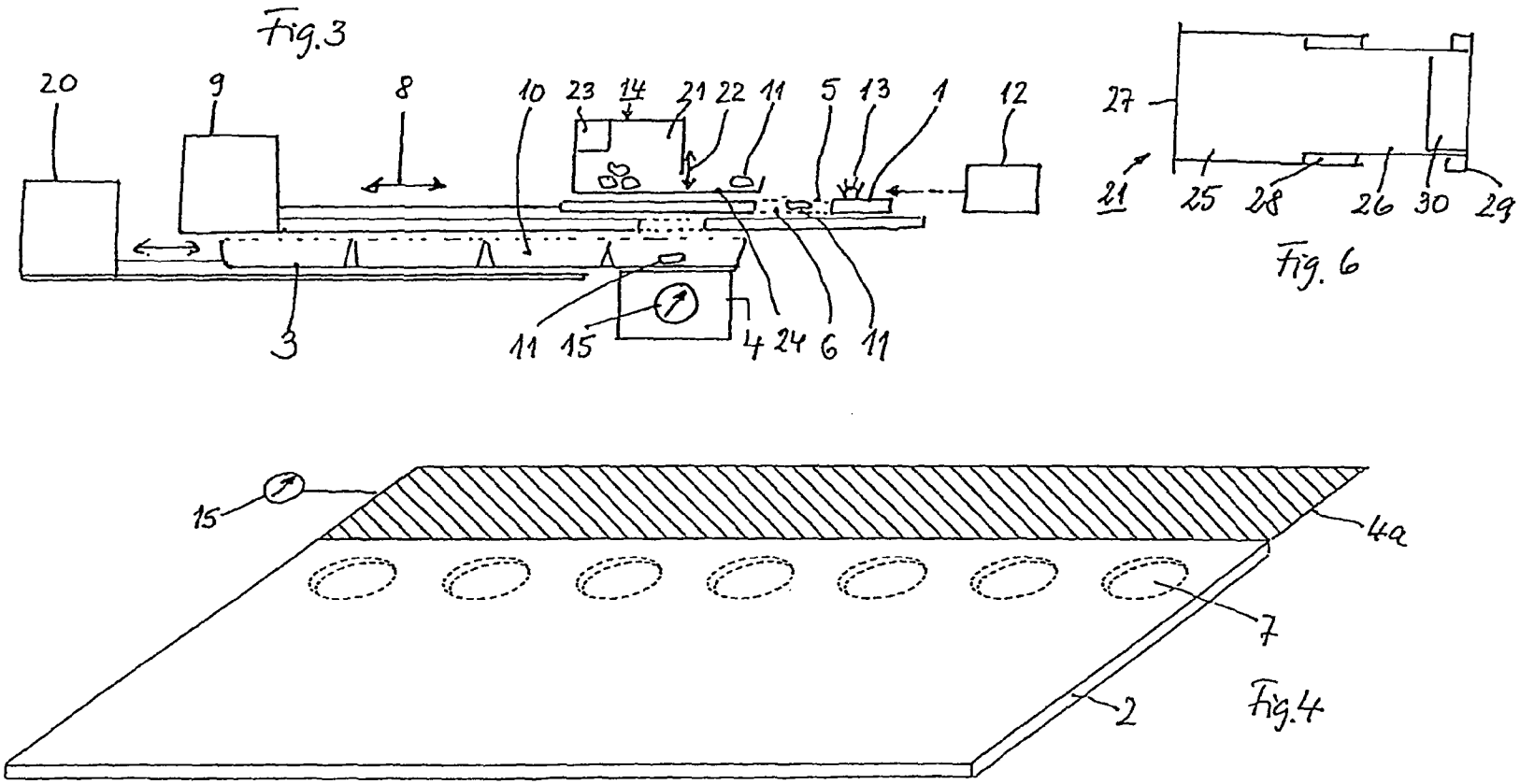
FIG. 3 an arrangement according to FIG. 1, with blister pack and scale, in vertical section.
FIG. 4 a control template to be assigned to the charging template, in each instance, with built-in scale.
FIG. 6 a tablet storage container.

FIG. 1 to 3 show a charging template 1, a control template 2, a tablet container, i.e. blister pack 3, and a scale 4. The two templates 1, 2 should be displaceable, relative to one another, and should lie flat on top of one another, preferably with planar surfaces (as planar plates). The charging template 1 possesses tablet nests 5 that (in FIG. 1) are closed off by the surface of the control template 2 that lies underneath, at the nest bottom 6. The control template 2 therefore forms the nest bottom 6, but possesses openings, i.e. holes 7 that are to be brought into coverage with the nests 5, by means of relative displacements of the templates 1 and 2, in the displacement direction 8, using a drive 9 (FIG. 2).

The tablet container, i.e. blister pack 3, for example according to FIG. 3, can possess rows and columns of tablet compartments 10. According to FIG. 3, a blister pack 3 is positioned underneath the control template 2 that acts like a control slide, and underneath its openings 7, in such a manner that its individual tablet compartments 10 of a weekly row of containers or blister packs stand vertically underneath one of the openings 7 and one nest 5 that is open on the bottom, in each instance. The control template 2 can be moved, relative to the charging template 1, using the drive 9. The tablets 11 inserted into the nests 5 drop through the openings 7 into the tablet compartment 10, in each instance, if applicable.

In order to ensure that the individual tablets 11 get into precisely the prescribed nest 5 of the charging template 1, the nests 5 can each have a photoeye 12 assigned to them. Furthermore, a light display 13 can light up on each nest 5 that is supposed to even be charged during the metering pass, in each instance. The photoeye 12 can be assigned to the space close to the nest bottom 6, for example at a height of 1 mm above the bottom, so that it reliably detects even the smallest tablets. If it registers an inserted tablet 11, it is supposed to turn off the lighted light display 13 on the nest in question—by way of related electronics. If the photoeye 12 cannot determine how many tablets were placed into a nest 5, the scale 4 (precision scale) can be used to check whether the correct number of tablets got into a nest 5, i.e. into a row of nests or row of compartments, during the filling process, in each instance. As an aside: The weight of an industrially produced tablet is a characteristic of the preparation, in each instance. There is hardly any preparation whose tablet weighs precisely as much as the tablet of a different preparation.

Filling of the nests 5 should preferably take place manually. However, an automatic commissioning device 14 can be provided for delivering the tablets. This device can comprise special storage containers 21 for every medication of every patient. This container should be equipped with means, for example a flap 22, for automatic, preferably airtight closing and opening (accessible to the operator). Preferably, a dehumidifier chamber 23 is provided within the storage container 21, which can accommodate a desiccant, such as silica gel, and is supposed to bind humidity within the storage container 21, if applicable. It is practical if the desiccant is equipped with a color indicator that shows whether the desiccant has been exhausted and therefore must be replaced. After the flap 22 is opened (direction of arrow), tablets 11, preferably a pre-determined number, can get out of the container 21 onto a tray 24, from where it is to be placed into a nest 5 (by the operator).

The automatic commissioning device 14 can also be used for automatic delivery and removal of tablet storage containers 21 and can be assigned to the charging template 1 within a tablet delivery station 19.

In an exemplary embodiment, a storage container 21 consists essentially of two tubes, particularly plastic tubes, which can be pushed into one another in the manner of a telescope, and can be firmly closed off at their ends with a rectangular plate, particularly also made of plastic. If applicable, the outer tube, which is always visible, should bear one or more cams that fit into corresponding recesses in the end piece of the inner tube, so that the container can be opened or closed by means of rotating the two end pieces relative to one another (bayonet closure). To protect the stored tablets, the outer tube should be pressed against a silicone seal by means of the clamping force of this closure, thus making it possible to seal it in airtight manner. The storage container should possess a removal opening with an insert, preferably a deep-drawn plastic part, which is adapted to the bulk volume of the tablets to be stored. This prevents the stored tablets from grinding against one another during transport procedures, like in a ball mill.

FIG. 4 shows a modification of the control template 2, according to the invention, where a scale 4 is coupled with the template, forming the nest bottoms 6 when the charging template 1, i.e. its nests 5, is/are filled. Preferably, the nest bottoms should rest on the scale 4. This scale registers whether one tablet 11 too much or too little got into a nest 5, for example using an indicator 15.

Figure 5:
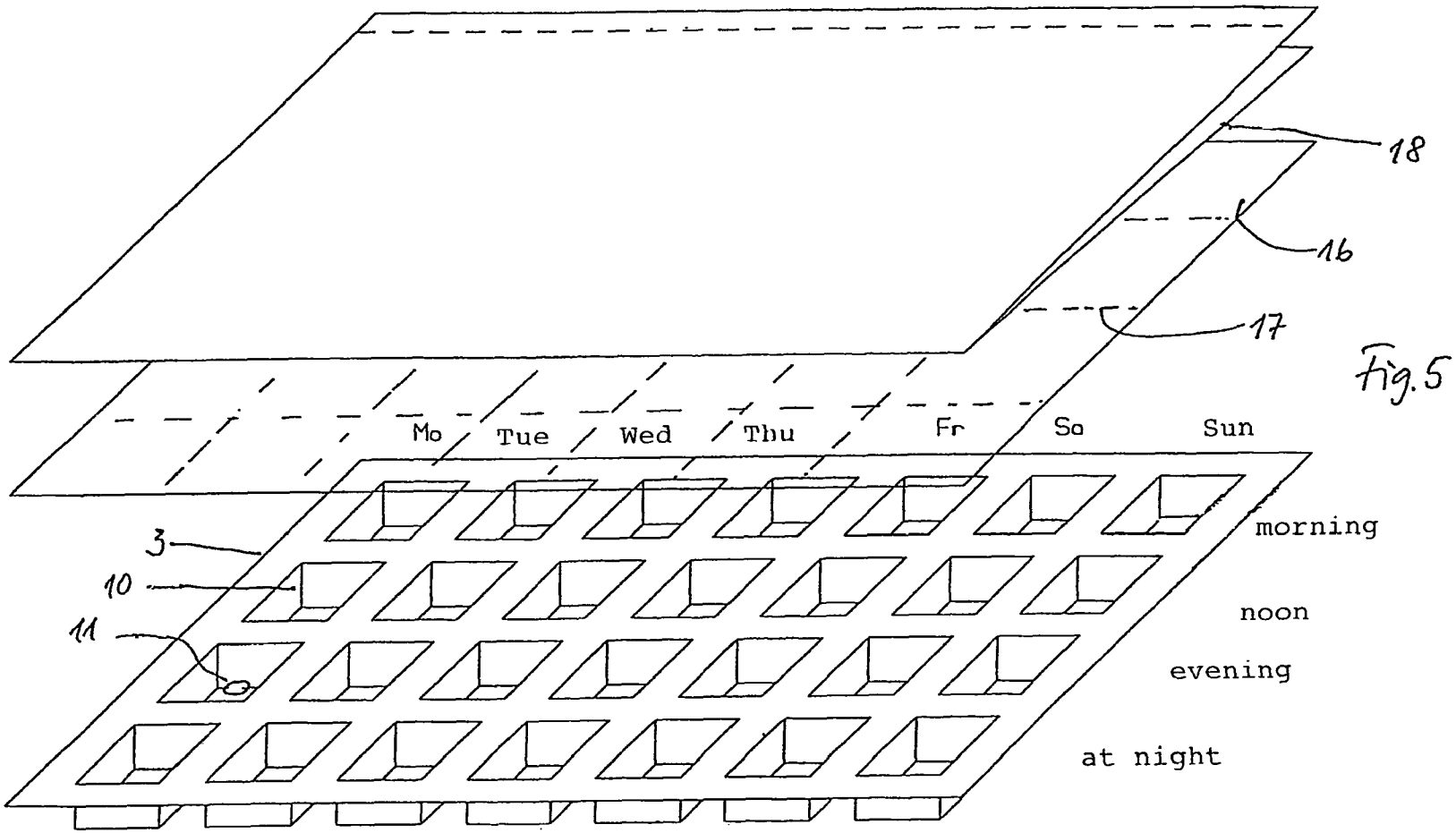
FIG. 5 a blister pack shown in perspective.

FIG. 5 shows, in the lower part, a blister pack 3 having four rows and seven columns of tablet compartments 10, as an example, namely one row each for four different times of day (morning, noon, evening, night), and one column each for the seven days of a week. Within the scope of the invention, blister packs having five and more rows for correspondingly many administration times per day and/or blister packs having more than seven columns for administration periods having a length of more than one week are also possible.

If the prescribed tablets 11 have been properly filled into the tablet compartments 10, and a blister pack is to be filled, the latter is brought into a heat-sealing station, where the individual blister pack compartments 10 are to be sealed with a sealing film/foil 16. The film/foil 16 can possess perforations 17 that allow the compartments 10 to be opened individually. The details described above can be imprinted onto the film/foil 16; furthermore, documentation 18 of the type indicated can be attached to the (sealed) blister pack.

In the following, a preferred exemplary embodiment is described, which was designed for operation with EDP control.

Only a single preparation, in other words only the same tablets, should be situated within a charging region, i.e. a tablet delivery station 19, spatially above the charging template 1 of FIG. 1 to 3, at any one time. In the case of the tablet container according to the invention, e.g. a blister pack 3, the preparation can be identified with the customer number of the patient, in each instance, the central pharmaceutical number, and the batch identifier, in machine-readable form, for example with a barcode. Specifically in the case of the EDP operation made possible according to the invention, these data are detected when the preparation, in each instance (tablet or tablet container) is brought in. If applicable, the administration plan for the individual patients should also be stored in the memory of the EDP that controls the system according to the invention. In connection with the aforementioned stored data, the entire selection and filling process described can then be carried out in the device according to the invention, without the risk of incorrect charging.

According to FIGS. 1 to 3, a tablet container, i.e. blister pack 3, which is still empty, for one week, for example, is spatially placed underneath charging and control template 1, 2, on a scale 4, by way of a mechanical feed, a so-called container positioner 20. The charging template 1 is then situated above the blister pack 3; it can be displaced relative to the blister pack 3. The nests 5 are situated in the template 1; the tablets 11, in each instance, are to be placed into them. Each nest 5 is provided with a photoeye 12, with which it can be detected whether at least one tablet 11 was placed in. Furthermore, a signal lamp 13 can be assigned to each nest 5, which is supposed to indicate to the operator the nests into which the current type of tablet is to be placed, if applicable, and goes out once a tablet has been placed in.

If all of the tablets of the preparation being worked on have now been placed into the nests 5 for an administration time (e.g. the morning), the charging template 1 is displaced, relative to the control template 2 (or the latter is displaced relative to the former), using the drive 9. As a result, the tablets 11 fall out of the nests 5 into the compartments 10 of the blister pack 3 that correspond to the administration time in question. At the same time, the scale 4 can be used to check whether the correct number of tablets was filled in.

Alternatively, the charging template 1 can also be mounted in fixed manner, and the scale 4 can be positioned underneath the template (FIG. 4). Then, the weighing process is already carried out when the tablets are placed into the nests 5. That part of the control template 2 that is situated underneath the charging nests 5 can be configured as a precision scale (4), if applicable. In the case of this arrangement, transfer of the tablets 11 into the blister pack 3 is triggered when all of the nests 5 to be charged have been served with the correct number of at most one tablet (weight).

If the preparation being worked on must be placed in again, two or more times for the same point in time or, in addition, for another point in time of the weekday in question, the nest bottoms 6 of the charging template 1 are closed again and the metering pass begins again. In order to transfer the tablets from the nests 5, the blister pack 3 can be brought into the desired or required relative position underneath the charging template 1, in each instance, using the container positioner 20.

Once all of the tablets of a preparation for the week in question are in the blister pack 3, the operator or the automatic commissioning device can be prompted (for example by way of the related EDP control) to remove the preparation from the system. Removal can be documented by scanning the barcode of the tablets or tablet container, in each instance. Once removal of the previously dosed tablets has been completed, the next preparation can be moved into the system. After this has been done, the procedure described can begin again.

FIG. 6 shows an exemplary embodiment of a tablet storage container 21 that is preferably to be used in the device according to the invention. This container consists essentially of two tubes to be inserted into one another in the manner of a telescope, namely an outer tube 25 and an inner tube 26. The one end of the two tubes is closed off by means of a plate 27, in each instance, which should be rectangular, for example in order to prevent rolling. A bayonet closure 28 is provided to connect, close, and separate the two tubes 25, 26. The interior enclosed by the tubes 25, 26 inserted into one another, which is supposed to accommodate the tablets, in each instance, can be sealed to be airtight, using a silicone seal 29 against which the outer tube 26, for example with its open end, is to be pressed by the clamping force of the closure 28. An insert 30 can be situated in the interior of the container, the volume of which is adapted to the bulk volume of the tablets to be stored.

Figure 9:
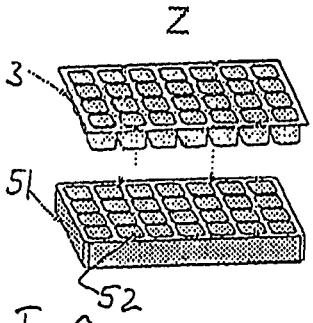
FIGS. 7 to 9 workstation equipped according to the invention.
Figure 7:
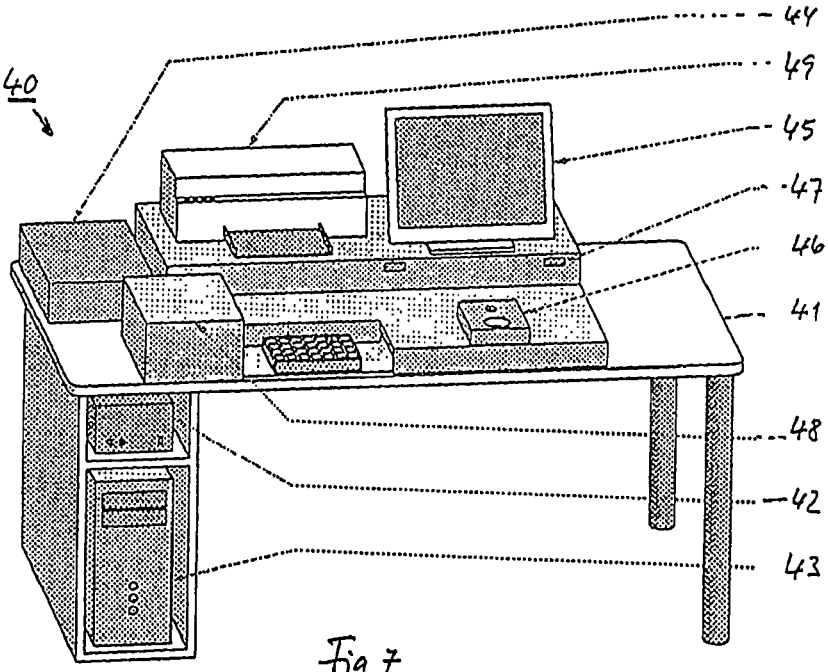

An exemplary embodiment of the system layout for a workstation 40 for individual blister pack packaging according to the invention will be explained using FIGS. 7 to 9. FIG. 7 shows a worktable 41 with a device for manual charging of the tablet containers positioned on it. The device includes a power supply 42, a PC 43, and a control 44, as well as a display 45. Furthermore, a metering unit 46, a scanner 47, and a heat-sealing press 48, as well as a printer 49, are situated at the workstation. The metering unit 46 includes a scale, three photoeyes, and a closure slide.

Figure 8:
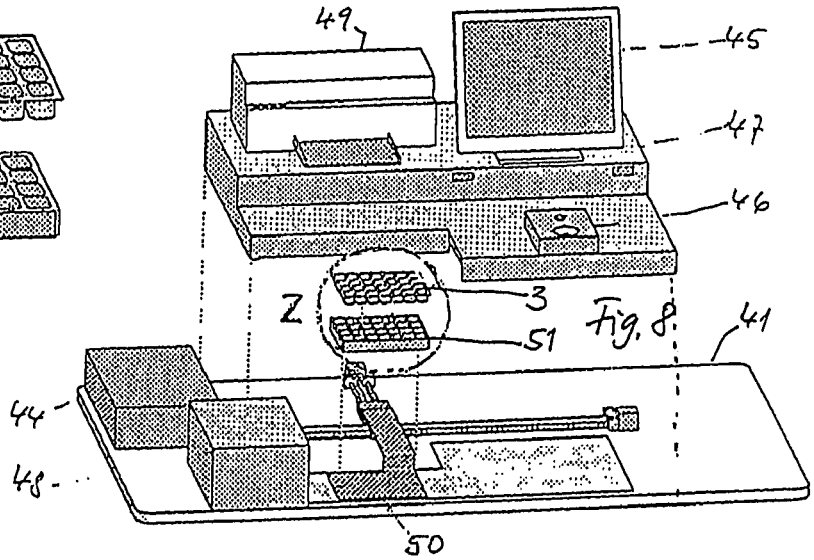

Details of the device according to FIG. 7 become evident in the exploded view according to FIG. 8, in which the same parts are numbered as in FIG. 7. In addition, FIG. 8 shows a tablet gripper 50 as well as a blister pack 3 with the related blister pack accommodation, i.e. die 51. The parts and 51 are shown once again on a larger scale, and individually, in detail Z according to FIG. 9. In this drawing, the pins 52 can also be seen, which serve to position the blister pack and the film/foil, respectively, and are positioned asymmetrically, in order to achieve the result that film/foil and blister pack can only be set onto the die 51 in a single position.

Figure 10:
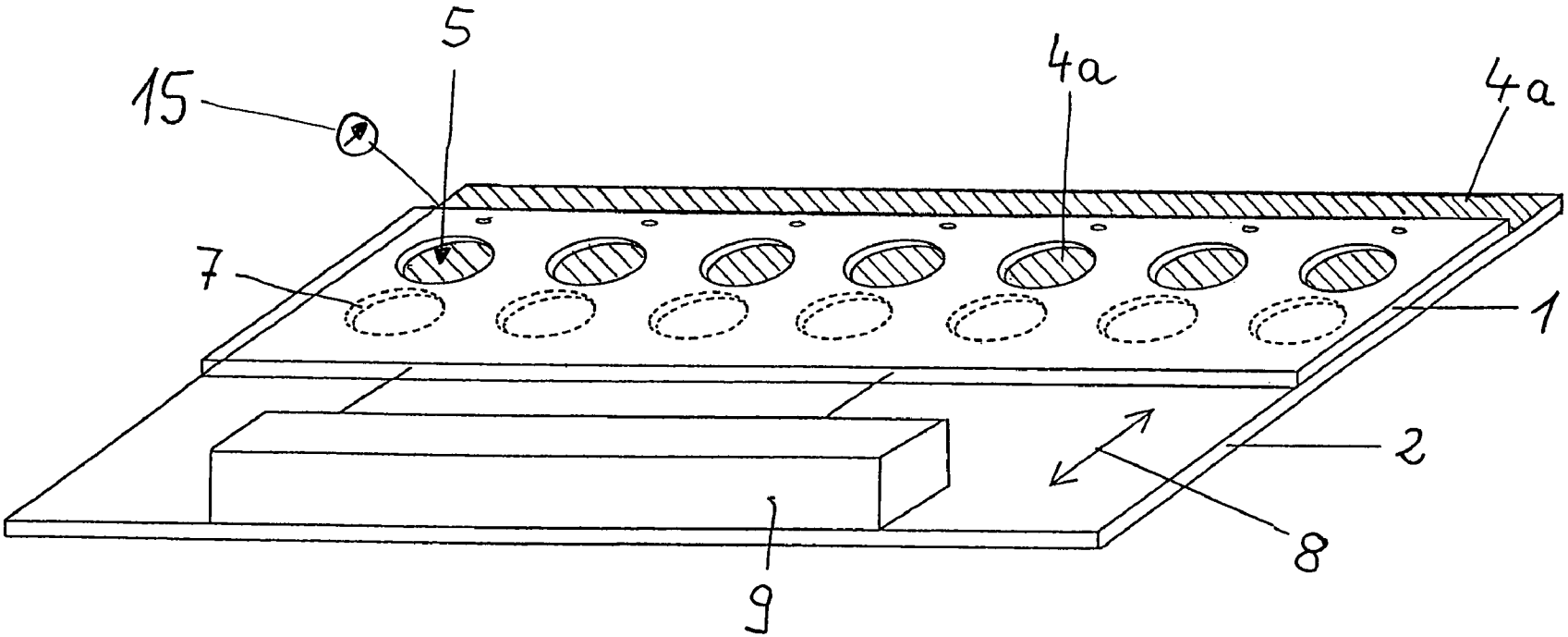
FIG. 10 the nest of the charging template resting on a scale.

FIG. 10 shows the bottoms of the nest 5 of the charging template 1 resting on a scale 4*a* when being filled through hole 7 and having display 15.

REFERENCE SYMBOL LIST

1=charging template
2=control template
3=tablet container
4=scale
5=nest
6=nest bottom
7=hole, opening
8=displacement direction
9=drive
10=tablet compartment
11=tablet
12=photoeye
13=light display
14=automatic commissioning device
15=display
16=sealing film/foil
17=perforation
18=documentation
19=tablet delivery station
20=positioner
21=storage container
22=flap
23=dehumidifier chamber
24=tablet
25=outer tube
26=inner tube
27=rectangular plate
28=bayonet closure
29=silicone seal
30=insert
40=workstation
41=worktable
42=power supply
43=PC
44=control
45=display
46=metering unit with scale, photoeye, and closure slide
47=scanner
48=heat-sealing press
49=printer
50=tablet gripper
51=blister pack accommodation, die
52=positioning pins

The invention claimed is:

1. Device for individual packaging of medication tablets (11) according to a multi-dose system, comprising a charging template (1) having at least one nest (5) for defined insertion of tablets (11) to be taken on predetermined days and/or times of day, whereby each of the nests (5), possesses a nest bottom (6) for passing the inserted tablets (11) on, which bottom is closed and is to be opened, a displaceably arranged control template (2) for opening and closing the nest (5) bottom (6) of the charging template, a tablet container (3) disposed spatially underneath the charging template (1), to be displaceable relative to the charging template, which container possesses tablet compartments (10) assigned to specific days and/or times of day, to be brought into coverage with the nest (5) bottom (6), for take-over of the tablets (11) present in the nests (5), and a weighing scale for checking the weight of the inserted tablets assigned to the charging template; and said weighing scale positioned beneath said charging template (1) and above the tablet container (13).

2. Device according to claim 1, wherein said displaceably arranged control template (2) is provided for opening and closing the nest (5) bottom (6), disposed above the tablet container (3) and spatially directly under the charging template (1), and that said displaceably arranged control template possesses openings (7) that are to be brought into coverage with the nest (5), by means of a relative displacement, which openings are provided as a passage for the tablets (11) present in the nest (5) to the tablet compartment (10) to be charged.

3. Device according to claim 2, wherein the charging template (1) or the displaceably arranged control template (2) and the tablet container (3) are mounted to be displaceable relative to one another in the horizontal direction (8).

4. Device according to claim 3, wherein mechanical pushing drives (9, 20) are provided for a relative movement of the displaceably arranged control template (2).

5. Device according to claim 1, wherein said weighing scale is assigned to the charging template, and wherein the bottoms (6) of the nest (5) of the charging template (1), rest on said weighing scale (4) when being filled.

6. Device according to claim 1, comprising a sensor assigned to each nest (5) of the charging template (1), for checking whether a tablet (11) was placed in.

7. device according to claim 6, wherein the sensor is a photoeye (12).

8. Device according to claim 1, wherein a display, is assigned to each nest (5), to indicate a local tablet demand.

9. Device according to claim 8, wherein the display is a signal lamp (13).

10. Device according to claim 1, wherein an automatic commissioning device (14) for automatic delivery and removal of tablet storage containers (21) is assigned to the charging template (1) within a tablet delivery station (19).

11. Device according to claim 10, wherein the automatic commissioning device (14) comprises a tablet storage container (21).

12. Device according to claim 11, wherein the container (21) has means (22) for automatic opening and closing in airtight manner.

13. Device according to claim 11, wherein the storage container (21) comprises a chamber (22) for accommodating a desiccant.

14. Device according to claim 13, wherein the storage container (21) consists essentially of two tubes (25, 26), which can be pushed into one another in the manner of a telescope, and are closed off at one end, with a plate (27), that the outer tube (26), which is always visible, bears at least one cam, which fits into a corresponding accommodation of the inner tube, that the tubes inserted into one another can be opened and closed by means of rotation relative to one another, that the outer tube is to be pressed against a seal, by means of the clamping force of this closure (29), thus making it possible to seal the storage container interior in airtight manner, and that the storage container contains an insert (30) adapted to the bulk volume of the tablets to be stored.

15. Device according to claim 14, wherein the tubes (25, 26) are plastic tubes; wherein the plate (27) is a rectangular plastic plate; wherein the outer tube (26) forms a bayonet closure (28); wherein the seal is a silicone seal (29); and wherein the insert (30) is a deep-drawn plastic part.

16. Device according to claim 1, wherein individual parts of the device, with charging template (1), control template (2), a positioning device (20) of the tablet container (3), and scale (4), are positioned in a specific spatial mutual arrangement.

17. Device according to claim 16, wherein the individual parts are installed into a table.

18. Device according to claim 1, comprising at least one removably attached documentation sheet.

19. Device according to claim 1, wherein the tablet container (3) can be positioned in its position on a charging region only in a single, defined position, by means of its shaping.

20. Device according to claim 1, wherein the tablet container (3) is configured as a medication cassette having a plurality of tablet compartments (10).

21. Device according to claim 20, wherein the tablet container (3) has compartments (10) having a flip-open or push-open lid and is a reusable cassette.

22. Device according to claim 1, wherein the tablet container (3) is configured as a blister pack having a plurality of tablet compartments (10).

23. Device according to claim 22, wherein a sealing film/foil is provided for closing off the compartments (10) of the blister pack, jointly for all the compartments, for a group of compartments, or separately for each individual compartment.

24. Device according to claim 22, wherein the sealing film/foil, is equipped with positioning aids for a defined position of the film/foil on the blister pack (3).

25. Device according to claim 1, wherein a cover that protects the nests and their contents from air drafts is assigned to the nests (5) of the charging template (1).

* * * * *